US011142429B2

(12) United States Patent
Shiraishi et al.

(10) Patent No.: US 11,142,429 B2
(45) Date of Patent: Oct. 12, 2021

(54) EMERGENCY STOP DEVICE FOR AN ELEVATOR CAR

(71) Applicant: MITSUBISHI ELECTRIC CORPORATION, Chiyoda-ku (JP)

(72) Inventors: Naohiro Shiraishi, Chiyoda-ku (JP); Seiji Watanabe, Chiyoda-ku (JP); Kotaro Fukui, Chiyoda-ku (JP); Eiji Ando, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 665 days.

(21) Appl. No.: 15/773,237

(22) PCT Filed: Nov. 26, 2015

(86) PCT No.: PCT/JP2015/083212
§ 371 (c)(1),
(2) Date: May 3, 2018

(87) PCT Pub. No.: WO2017/090145
PCT Pub. Date: Jun. 1, 2017

(65) Prior Publication Data

US 2018/0319628 A1 Nov. 8, 2018

(51) Int. Cl.
*B66B 5/22* (2006.01)
*B66B 5/18* (2006.01)
*B66B 5/28* (2006.01)

(52) U.S. Cl.
CPC ..... *B66B 5/22* (2013.01); *B66B 5/18* (2013.01); *B66B 5/28* (2013.01)

(58) Field of Classification Search
CPC .. B66B 5/18; B66B 5/22; B66B 5/044; B66B 5/28
See application file for complete search history.

(56) References Cited

U.S. PATENT DOCUMENTS 4,565,264 A * 1/1986 Kunii ..... B66B 5/06 187/373
9,873,592 B2 * 1/2018 Powers ..... B66B 5/044

FOREIGN PATENT DOCUMENTS

CN 104395220 A 3/2015
JP 53-071445 A 6/1978
JP 05-31 9724 A 12/1993

OTHER PUBLICATIONS

International Search Report dated Mar. 1, 2016 in PCT/JP2015/083212, filed on Nov. 26, 2015.
Chinese Office Action dated Feb. 25, 2019 in Chinese Application No. 201580084641.2.

* cited by examiner

*Primary Examiner* — Diem M Tran
(74) *Attorney, Agent, or Firm* — Xsensus LLP

(57) ABSTRACT

An emergency stop device for an elevator car, including: a link configured to be rotated about a rotary shaft installed on a car by movement of a speed governor rope; a rail stopper provided to one end of the link; a roller guide mounted to the car; and an elastic member provided between another end of the link and the car. The elastic member causes a spring reaction force to be reduced to bring the rail stopper into abutment against the roller guide even when the rail stopper is displaced by the link, when the displacement exceeds a preset threshold value due to further displacement by the link along with the movement of the speed governor rope at a time of occurrence of rope breakage.

3 Claims, 6 Drawing Sheets

NORMAL OPERATION

E STOP

ROPE BREAKAG

NORMAL OPERATION

E STOP

ROPE BREAKAG

NORMAL OPERATION

SEPARATING POSITION

AFTER SEPARATION

NORMAL OPERATION

E STOP

ROPE BREAKAGE

EMERGENCY STOP DEVICE FOR AN ELEVATOR CAR

TECHNICAL FIELD

The present invention relates to an emergency stop device for an elevator car, and more particularly, to an emergency stop device which is configured to bring an elevator car to an emergency stop at the time of occurrence of rope breakage or other event.

BACKGROUND ART

An emergency stop device for an elevator car (hereinafter simply referred to as "car") has a configuration of using inertia of a speed governor rope to move up a wedge-like rail stopper in accordance with an acceleration of the car, and can be quickly operated at the time of occurrence of rope breakage even when a speed of the car is low.

Through use of the emergency stop device described above, the car can be quickly decelerated at the time of occurrence of rope breakage during running near a bottom floor where the speed of the car is low. As a result, it is sufficient for a buffer installed in a pit at a lower end of a hoistway to have a small size.

For design of the emergency stop device, when the car is decelerated by braking of a hoisting machine (E stop), it is desired that the emergency stop device not operate. Specifically, it is desired that the rail stopper not be moved up to a position (rail contact position) at which an emergency stop operation is performed. Therefore, a spring reaction force or other forces is applied to the emergency stop device in a direction in which the rail stopper is not moved up.

Meanwhile, at the time of occurrence of the rope breakage, time required to start the operation of the emergency stop device increases as the spring reaction force becomes larger. As a result, a large-size buffer is required.

There also exists an emergency stop device which restricts the rail stopper so that the rail stopper can be raised only at the time of occurrence of the rope breakage (see, for example, Patent Literature 1).

CITATION LIST

Patent Literature

[PTL 1] WO 13/157069 A1

SUMMARY OF INVENTION

Technical Problem

In the case of Patent Literature 1, there is a problem in that a mechanism for ensuring reliability of rope breakage detection is additionally required.

The present invention has been made to solve the above-mentioned problem, and has an object to provide an emergency stop device for an elevator car, which is capable of holding a rail stopper so that the rail stopper is not moved up at the time of braking of a hoisting machine and causing the rail stopper to be quickly moved up at the time of occurrence of the rope breakage, and requires neither a large-size buffer nor a mechanism for ensuring reliability of the rope breakage detection.

Solution to Problem

In order to achieve the above-mentioned object, according to one embodiment of the present invention, there is provided an emergency stop device for an elevator car, including: a link configured to be rotated about a rotary shaft installed on a car by movement of a speed governor rope; a rail stopper provided to one end of the link; a roller guide mounted to the car; and an elastic member provided between another end of the link and the car, in which the elastic member has a spring reaction force which prevents the rail stopper from being brought into abutment against the roller guide even when the elastic member is displaced by the link along with the movement of the speed governor rope at a time of braking of a hoisting machine, and the elastic member has a characteristic which causes the spring reaction force to be reduced to bring the rail stopper into abutment against the roller guide when the displacement exceeds a preset threshold value due to further displacement by the link along with the movement of the speed governor rope at a time of occurrence of rope breakage.

Advantageous Effects of Invention

The emergency stop device for an elevator car according to one embodiment of the present invention has the configuration in which the elastic member has the spring reaction force which prevents the rail stopper from being brought into abutment against the roller guide even when the rail stopper is displaced by the link along with the movement of the speed governor rope at a time of braking of a hoisting machine, and the elastic member has a characteristic which causes the spring reaction force to be reduced to bring the rail stopper into abutment against the roller guide when the displacement exceeds a preset threshold value due to further displacement by the link along with the movement of the speed governor rope at the time of occurrence of rope breakage. Therefore, the rail stopper is held so that the rail stopper is not moved up at the time of braking of the hoisting machine, and the rail stopper can be quickly moved up at the time of occurrence of the rope breakage. Thus, there is obtained an effect that neither a large-size buffer nor a mechanism for ensuring reliability of the rope breakage detection is required.

DESCRIPTION OF EMBODIMENTS

Now, an emergency stop device for an elevator car according to the present invention is described in detail with reference to the drawings.

First Embodiment (in a Case where a Non-Linear Spring is Used)

Figure 1A:
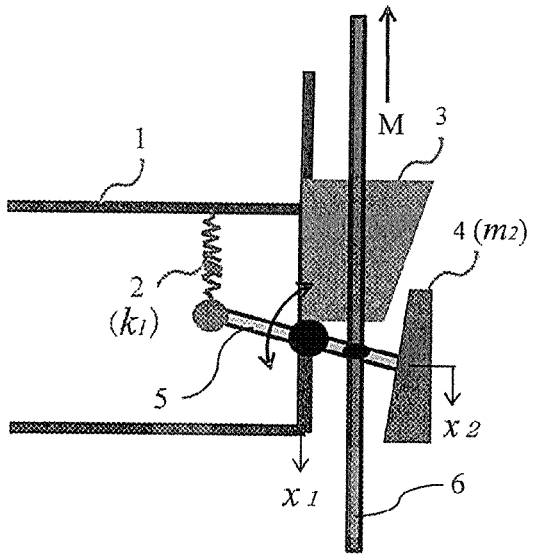
FIG. 1A is a schematic structure view for illustrating an emergency stop device for an elevator car according a first embodiment of to the present invention.
Figure 1B:
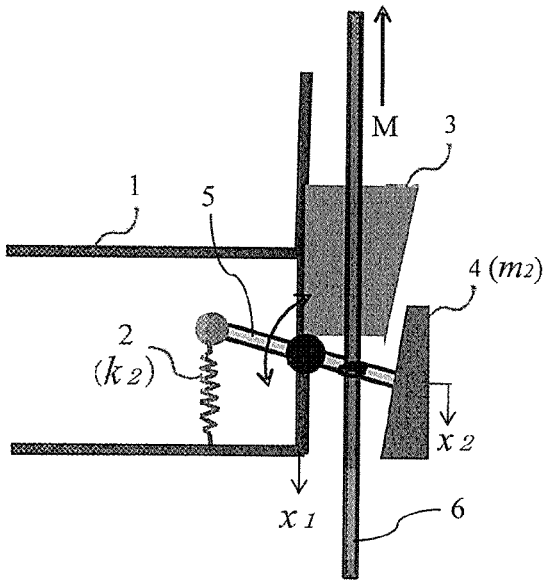
FIG. 1B is a schematic structure view for illustrating an emergency stop device for an elevator car according a first embodiment of to the present invention.

FIG. 1A and FIG. 1B are views for illustrating an emergency stop device for an elevator car according to a first embodiment of the present invention. FIG. 1A is a view for illustrating an example in which a tension spring 2 serving as a malfunction prevention spring is connected from an upper part of a car 1. FIG. 1B is a view for illustrating an example in which the tension spring 2 serving as a malfunction prevention spring is connected from a lower part of the car 1.

A roller guide 3 which constructs an emergency stop mechanism is mounted to the car 1 and is also fixed to a speed governor rope 6. A rail stopper 4 is provided so as to be opposed to the roller guide 3. The rail stopper 4 is mounted to one end of a link 5, and the spring 2 is connected to another end of the link 5. A rotary shaft of the link 5 is installed on the car 1.

In an operation, schematically, when the car 1 falls at a speed equal to or higher than a given speed, braking of a hoisting machine is performed. Inertia given at this time causes the speed governor rope 6 to be moved up in a direction indicated by the arrow. Thus, the speed governor rope 6 moves in a direction opposite to the movement of the car 1. This action causes the link 5 to rotate about the rotary shaft on the car 1. Therefore, the spring 2 is pulled, and the rail stopper 4 is moved up.

At the time of occurrence of rope breakage, the rail stopper 4 is brought into abutment against the roller guide 3 to stop the fall of the car 1.

Figure 2:
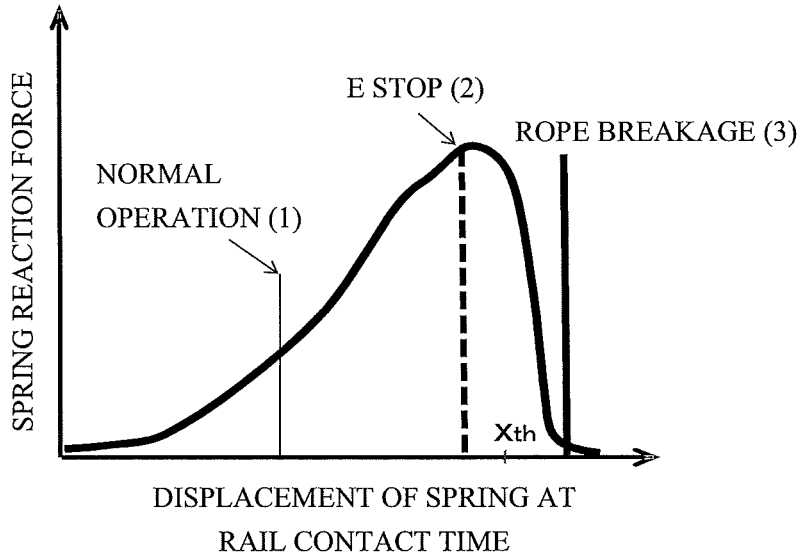
FIG. 2 is a graph for showing a characteristic of a spring used for the emergency stop device for an elevator car according to the present invention.

First, as a solution to the problem described above, the inventors of the present invention has focused on the fact that the spring 2 has a spring displacement characteristic which is specific to a rail contact time. Specifically, as shown in FIG. 2, the spring displacement characteristic causes a spring reaction force to be sharply reduced when spring displacement becomes larger than that at the time of an E stop corresponding to the time of braking of the hoisting machine, that is, when the rail stopper 4 is moved up to an amount equal to or larger than a threshold value $x_{th}$.

Then, through setting of a spring displacement position to a position larger than a position with a maximum upward movement amount assumed at the time of the E stop, a spring reaction force is eliminated at the time of occurrence of the rope breakage (1 G). As a result, the rail stopper 4 is quickly moved up.

Meanwhile, at the time of the E stop (0.5 G) which is smaller than the threshold value $x_{th}$, the spring reaction force is not lost. As a result, a resistance to upward movement can be maintained to exert the braking of the hoisting machine.

Therefore, in the first embodiment, there is used the spring 2 having the characteristic which enables the rail stopper to be held so that the rail stopper is not moved at the time of braking of the hoisting machine and to be quickly moved up at the time of the rope breakage.

Although there exists a related art in which a spring force is caused to act in an opposite direction when a lift rod is moved up to a middle position by using the link or other members (for example, Japanese Patent Application Laid-open No. 2000-219450), such related art is not used for shortening operating time of the emergency stop device which involves an inertia action.

Now, the spring characteristic in the emergency stop device illustrated in FIG. 2 is mathematically analyzed. Parameters are set as follows.

- Own weight of the rail stopper 4: $m_2$
- Sum of rotational inertia of a speed governor system (rotational inertia caused by the self-weight of the speed governor rope and rotational inertia of a speed governor and a tension sheave): M
- Displacement of the car: $x_1$
- Displacement of the rail stopper 4: $x_2$
- Displacement of a portion on a side opposite to a center of rotation: $x_4$
- Constant of the malfunction prevention spring 2: $k_1$
- Ratio of a distance between the spring and the center of rotation and a distance between the speed governor rope and the center of rotation: h An equation of motion is obtained as Expression (1) based on the parameters.

$$(m_2+M)\ddot{x}_2=-h^2k_1(x_2-x_1)+m_2g \qquad \text{Expression (1)}$$

When a spring displacement with which the reaction force is lost is defined as $x_{th}$, the spring constant $k_1$ of the spring 2 is expressed by Expression (2).

$$k_1=\begin{cases} k_0(\text{given value}) & (h(x_2-x_1)\le x_{th}) \\ 0 & (h(x_2-x_1)>x_{th}) \end{cases} \qquad \text{Expression (2)}$$

When the upward movement amount is defined as $y_2=x_1\cdot x_2$, Expression (1) can be rewritten into Expression (3).

$$\ddot{y}_2=-\frac{h^2k_1}{m_2+M}y_2+\left(\beta-\frac{m_2}{m_2+M}\right)g \qquad \text{Expression (3)}$$

where a constant acceleration of $\ddot{x}_1=\beta g$ ($0<\beta\le 1$) is used as a condition.

When Expression (3) is solved with the spring 2 under a condition that the spring 2 is linear, Expression (4) is obtained.

$$y_2 = \frac{(\beta(m_2 + M) - m_2)g}{h^2 k_0}(1 - \cos\omega t) \quad \text{Expression (4)}$$

$$\text{where } \omega = \sqrt{\frac{h^2 k_0}{m_2 + M}}$$

It is required to provide design with the following conditions. That is, the displacement of the spring becomes larger than that at a switching position when $\beta=1$ (at the time of the rope breakage) is given, and a maximum value of the spring displacement as the linear spring does not become larger than the switching position $x_{th}$ when $\beta=0.5$ (at the time of the E stop) is given. Thus, Expression (5) is obtained.

$$\frac{(M - m_2)g}{h^2 k_o} < \frac{x_{th}}{h} < \frac{2Mg}{h^2 k_0} \quad \text{Expression (5)}$$

The equation of motion after the elimination of the spring reaction force corresponds to a case where $k_1=0$ is given in Expression (3). Therefore, Expression (6) is obtained.

$$\ddot{y}_2 = \left(\beta - \frac{m_2}{m_2 + M}\right)g \quad \text{Expression (6)}$$

Thus, a parabolic motion is given.

Further, when a switching timing is defined as $t_{th}$, a position to which the rail stopper 4 is moved up and a speed of the upward movement at the switching timing are expressed respectively by Expressions (7) and (8).

$$y_{2th} = \frac{x_{th}}{h} = \frac{(\beta(m_2 + M) - m_2)g}{h^2 k_0}(1 - \cos\omega t_{th}) \quad \text{Expression (7)}$$

$$\dot{y}_{2th} = \frac{(\beta(m_2 + M) - m_2)g}{h^2 k_0}(\sin\omega t_{th}) \quad \text{Expression (8)}$$

Based on the successive conditions, the equation of motion after the switching is expressed by Expression (9).

$$y_2 = \frac{g}{2}\left(\beta - \frac{m_2}{m_2 + M}\right)(t - t_{th})^2 + \dot{y}_{2th}(t - t_{th}) + x_{th} \quad \text{Expression (9)}$$

As described above, it is understood that, the emergency stop device according to the present invention operates based on the expressions described above by using the spring having the characteristic shown in FIG. 2.

Figure 3:
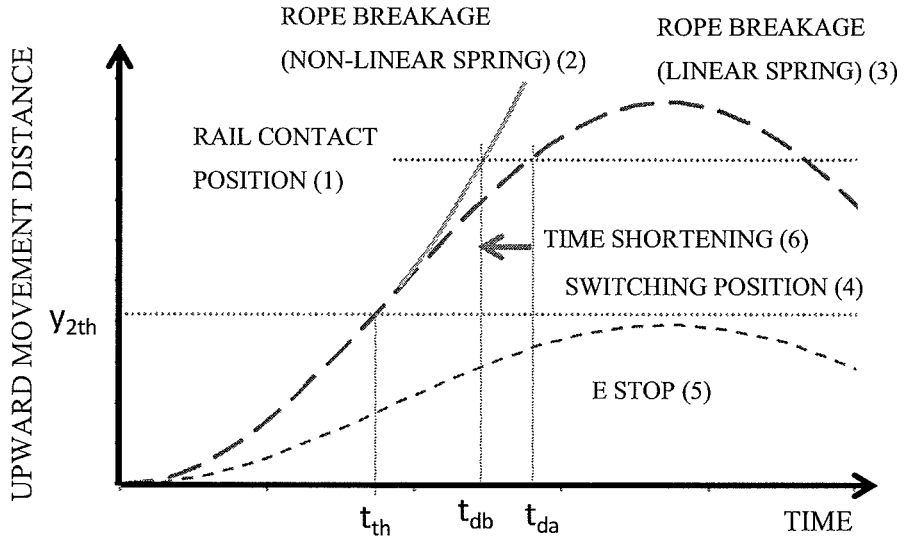
FIG. 3 is a graph for showing effects of the emergency stop device for an elevator car according to the first embodiment of the present invention.

Further, in this embodiment, as shown in FIG. 3, when the non-linear spring is used, the upward movement operation (time at which the rail stopper 4 reaches a rail contact position (1)) performed at the time of occurrence of the rope breakage is advanced from $t_{da}$ to $t_{db}$ as indicated by the line (6) as compared to the case (3) in which the linear spring is used. This is because the spring reaction force is eliminated during the operation. Meanwhile, an operation (5) at the time of the E stop is performed over a distance equal to or smaller than an upward movement distance $y_{2th}$ at the switching position (4), and therefore no effect is produced thereby. Thus, it is understood that a range of design of the emergency stop device which involves the inertia action can be expanded.

The configuration is not limited to the configuration illustrated in FIG. 1A. The spring may be installed in such an orientation as to become a resistance when the rail stopper of the emergency stop device is moved up so that the spring reaction force is reduced when the displacement of the spring or a force applied to the spring 2 becomes equal to or larger than a constant value.

Specifically, there are conceivable variations such as a configuration of using a spring 2 in a pressing direction as illustrated in FIG. 1B, a configuration of installing the spring on the rail stopper 4 side, a configuration of installing another link which interlocks with the upward movement and providing the spring on the link, and a configuration of installing a rotational spring to the center of rotation.

<Modification Examples of Spring 2>

As the spring 2 according to the first embodiment illustrated in FIG. 1A and FIG. 1B, the following modification examples are given as having the spring characteristic shown in FIG. 2. It is noted that the emergency stop device is designed to eliminate the spring reaction force so as to be operated only at the time of rope breakage. Therefore, even when a resistance force to the upward movement is not recovered after an emergency stop operation, the emergency stop device is held in an easily operable state. Thus, no problem arises in terms of safety.

1) Example of Causing the Spring to be Broken (in the Case of the Tension Spring)

For the tension spring, the spring is designed to have the spring characteristic shown in FIG. 2 which causes the spring to be broken when a tension equal to or larger than a certain value is applied. In this manner, a non-linear characteristic can be achieved.

2) Example of Bending the Spring (in the Case of the Compression Spring)

Figure 4A:
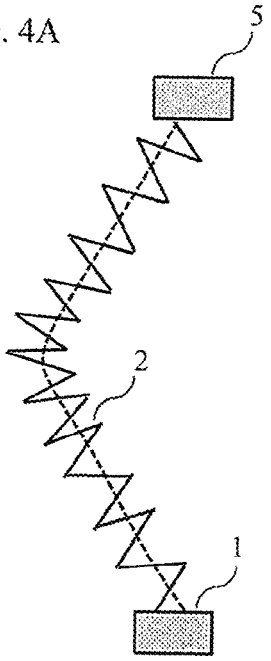
FIG. 4A is a schematic view for illustrating modification examples of the spring illustrated in FIG. 1A and FIG. 1B.
Figure 4B:
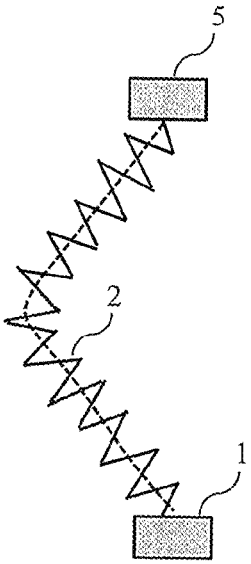
FIG. 4B is a schematic view for illustrating modification examples of the spring illustrated in FIG. 1A and FIG. 1B.
Figure 4C:
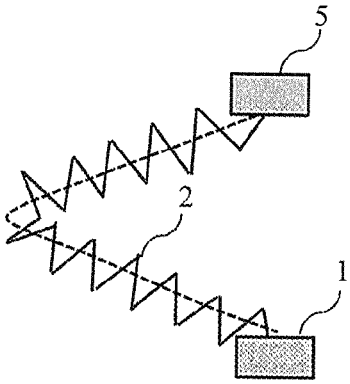
FIG. 4C is a schematic view for illustrating modification examples of the spring illustrated in FIG. 1A and FIG. 1B.

The spring is installed in a state of being pre-bent as illustrated in FIG. 4A to FIG. 4B to cause a bend in the middle. In this manner, the non-linear characteristic (buckling) shown in FIG. 2 is achieved under a state illustrated in FIG. 4C.

3) Method of Providing an Intermediate Portion to the Spring (in the Case of Both the Tension Spring and the Compression Spring)

Figure 4D:
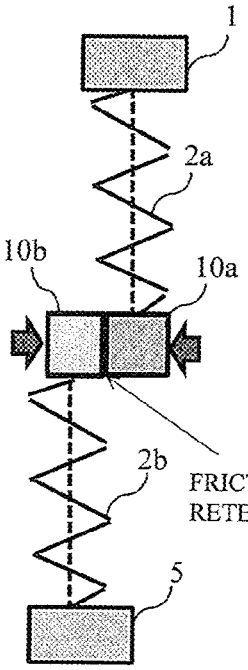
FIG. 4D is a schematic view for illustrating modification examples of the spring illustrated in FIG. 1A and FIG. 1B.
Figure 4E:
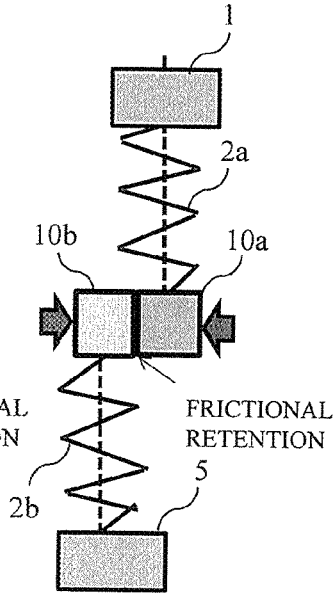
FIG. 4E is a schematic view for illustrating modification examples of the spring illustrated in FIG. 1A and FIG. 1B.
Figure 4F:
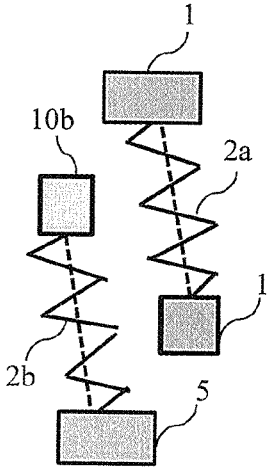
FIG. 4F is a schematic view for illustrating modification examples of the spring illustrated in FIG. 1A and FIG. 1B.

As illustrated in FIG. 4D to FIG. 4F, the spring includes springs 2*a* and 2*b* which are integrated through frictional retention members 10*a* and 10*b*. As a result, when a compressive force or a tensile force exceeds a threshold value, the springs cannot be retained with a frictional force and are separated from each other to eliminate the spring reaction force as illustrated in FIG. 4F. The intermediate members may be integrated by a change in magnetic force between magnets, a change in pressure between suckers, an adhesive, or by providing a portion having a low strength instead of providing the frictional members.

Figure 5A:
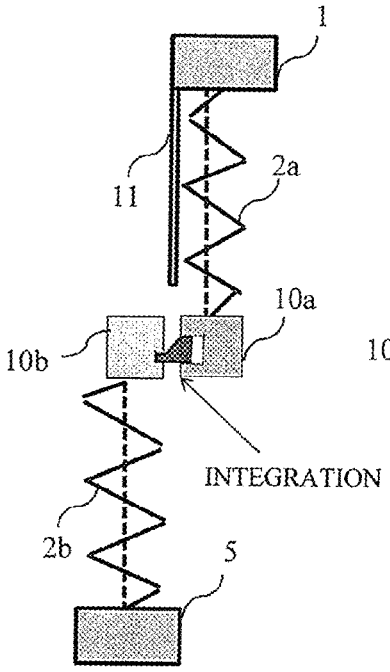
FIG. 5A is schematic view for illustrating further modification examples of the spring illustrated in FIG. 1A and FIG. 1B.
Figure 5B:
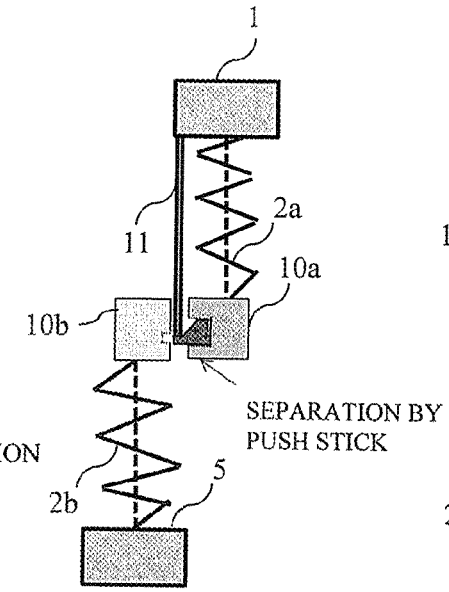
FIG. 5B is a schematic view for illustrating further modification examples of the spring illustrated in FIG. 1A and FIG. 1B.
Figure 5C:
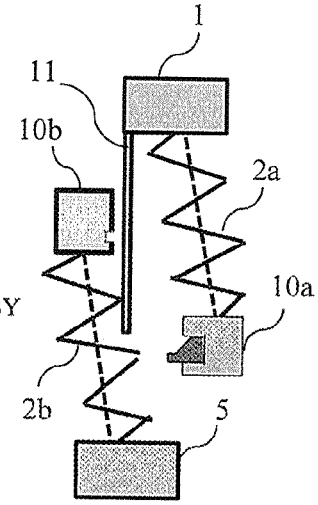
FIG. 5C is a schematic view for illustrating further modification examples of the spring illustrated in FIG. 1A and FIG. 1B.

Further, it is possible to use not only the structure in which the frictional retention members 10*a* and 10*b* are separated based on the compressive force or the tensile force as a reference but also a structure in which the frictional retention members 10*a* and 10*b* are separated based on a reference displacement by using a push stick 11, as illustrated in FIG. 5A to FIG. 5C.

4) Method of Using a Mechanism of a Spring Bearing (in the Case of Both the Tension Spring and the Compression Spring)

Figure 5D:
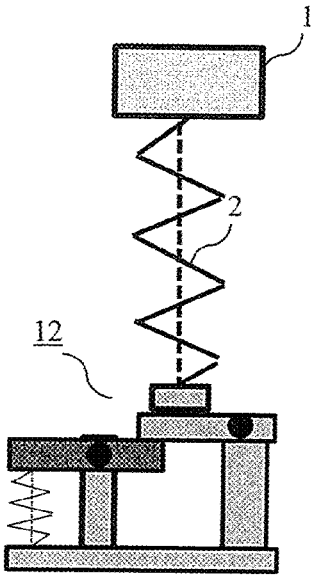
FIG. 5D is a schematic view for illustrating further modification examples of the spring illustrated in FIG. 1A and FIG. 1B.
Figure 5E:
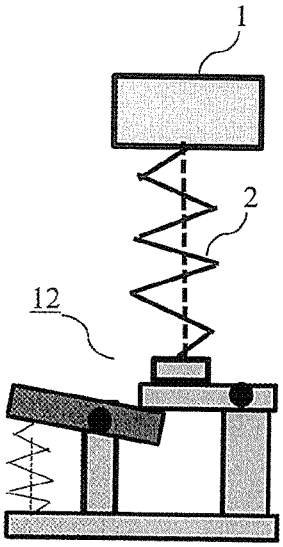
FIG. 5E is a schematic view for illustrating further modification examples of the spring illustrated in FIG. 1A and FIG. 1B.
Figure 5F:
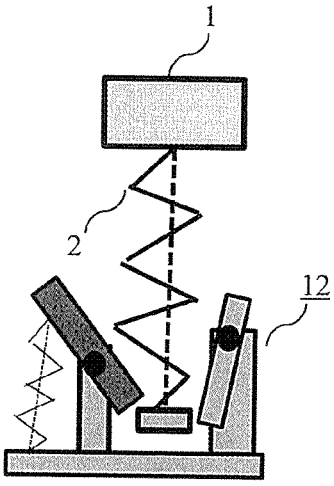
FIG. 5F is a schematic view for illustrating further modification examples of the spring illustrated in FIG. 1A and FIG. 1B.

As illustrated in FIG. 5D to FIG. 5F, through use of a link or other members for a spring bearing which is a connecting portion between the spring and the member to be moved upward or the car, a mechanism 12 in which the spring bearing is disconnected when a force equal to or larger than a certain value is applied, is constructed. Although a structure in which the spring bearing is disconnected by pressing is illustrated in this example, a structure in which the spring bearing is disconnected by pulling may also be used. Further, the friction, the magnetic force, an adhesive force, or other forces may be used for a connection/disconnection structure as in the case of the intermediate portion described above, or a structure in which the spring bearing is disconnected based on the displacement as a reference may be used.

Second Embodiment (in a Case where an Additional Weight is Provided)

In the first embodiment described above, the spring reaction force is reduced when the spring is moved by a predetermined displacement amount independently of a car acceleration even in the case of malfunction. Therefore, the displacement amount by which the spring reaction force is eliminated is required to be set to a relatively large value. Therefore, the operation to the switching position requires the same amount of time as for existing configurations even in a case of the rope breakage. Thus, an effect of shortening the operating time as a whole is limited.

Figure 6:
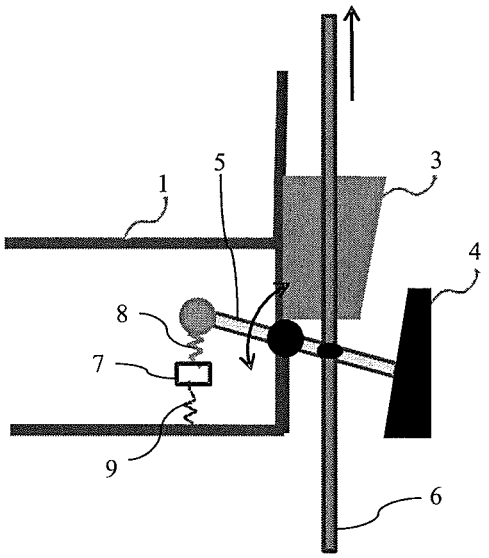
FIG. 6 is a schematic structural view for illustrating an emergency stop device for an elevator car according a second embodiment of to the present invention.

The time shortening effect can be improved by providing a configuration in which the malfunction prevention spring 2 is divided so as to sandwich an additional weight 7 therebetween as illustrated in FIG. 6. The additional weight 7 is retained by springs 8 and 9 and therefore is vertically displaced in accordance with an acceleration of the car 1. Through use of this vertical displacement, when the car acceleration is large (when the rope breaks), the additional weight 7 is largely lifted up with respect to the car 1 to place the upper spring 8 in a pre-compressed state. Therefore, the upward movement amount of the rail stopper 4 to the switching position can be reduced.

Meanwhile, at the time of the E stop, an uplift amount of the additional weight 7 is small. Therefore, the amount of upward movement of the rail stopper 4 to the switching position is increased.

Figure 7:
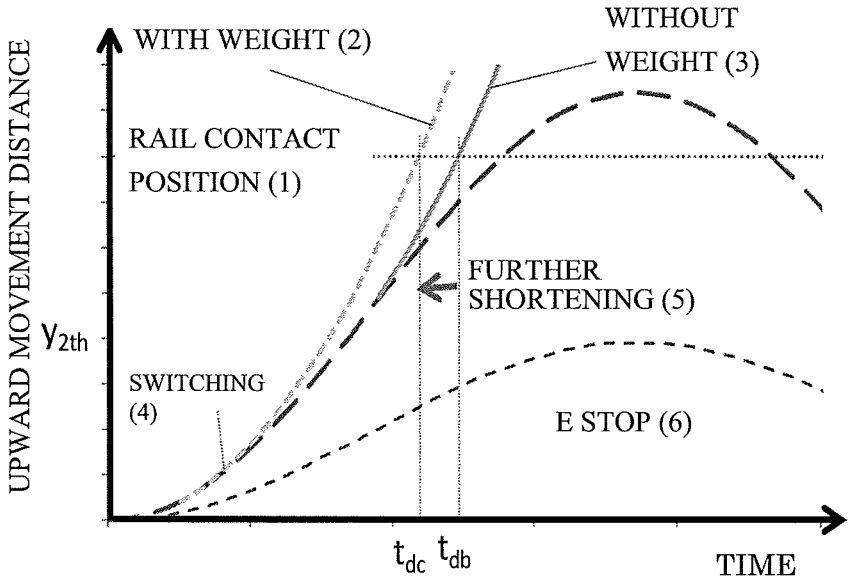
FIG. 7 is a graph for showing effects the emergency stop device for an elevator car according to the second embodiment of the present invention.

As described above, the displacement amount at which the spring reaction force is substantially eliminated can be switched depending on the car deceleration. Therefore, as indicated by the line (5) in FIG. 7, an emergency stop operation time when the rope breaks can be further shortened.

Further, the additional weight 7 itself can be designed independently of specifications of an elevator apparatus. Thus, the emergency stop operation time alone can be shortened while using an existing mechanism.

The invention claimed is:

1. An emergency stop device for an elevator car, comprising:

a link to be rotated about a rotary shaft installed on the elevator car by movement of a speed governor rope;

a rail stopper at one end of the link;

a roller guide mounted to the elevator car; and a single elastic member between another end of the link and the elevator car, wherein the single elastic member has a spring reaction force which prevents the rail stopper from being brought into abutment against the roller guide even when the rail stopper is displaced by the link along with the movement of the speed governor rope at a time of braking, and the single elastic member has a characteristic which causes the spring reaction force to be reduced to bring the rail stopper into abutment against the roller guide when displacement exceeds a preset threshold value due to further displacement by the link along with the movement of the speed governor rope at a time of occurrence of rope breakage, and wherein the displacement of the single elastic member occurs in a direction in which the single elastic member is pressed, and the single elastic member has a pre-bent portion formed in an intermediate portion and has a characteristic which causes the single elastic member to be bent at the pre-bent portion when the displacement of the single elastic member exceeds the preset threshold value.

2. An emergency stop device for an elevator car, comprising:

a link to be rotated about a rotary shaft installed on the elevator car by movement of a speed governor rope;

a rail stopper at one end of the link;

a roller guide mounted to the elevator car; and a single spring between another end of the link and the elevator car, wherein the single spring has a spring reaction force which prevents the rail stopper from being brought into abutment against the roller guide even when the rail stopper is displaced by the link along with the movement of the speed governor rope at a time of braking, and the single spring has a characteristic which causes the spring reaction force to be reduced to bring the rail stopper into abutment against the roller guide when displacement exceeds a preset threshold value due to further displacement by the link along with the movement of the speed governor rope at a time of occurrence of rope breakage, and wherein the displacement of the single spring occurs in a direction in which the single spring is pressed, and the single spring has a pre-bent portion formed in an intermediate portion and has a characteristic which causes the single spring to be bent at the pre-bent portion and to have an increased angle at the pre-bent portion when the displacement of the single spring exceeds the preset threshold value.

3. An emergency stop device according to claim 1, wherein:

the single elastic member has an increased angle at the pre-bent portion when the displacement of the elastic member exceeds the preset threshold value.

* * * * *